US005280859A

United States Patent [19]

Rust et al.

[11] Patent Number: 5,280,859

[45] Date of Patent: * Jan. 25, 1994

[54] VERTICAL FEED MILL SYSTEM

[76] Inventors: Marcus Rust, R.R. 5, Box 668, Seymour, Ind. 47294; Jeff Wilson, deceased, late of Brook, Ind.; by Cynthia Wilson, executrix, P.O. Box 45, Brook, Ind. 47922

[ * ] Notice: The portion of the term of this patent subsequent to Jul. 27, 2010 has been disclaimed.

[21] Appl. No.: 877,428

[22] Filed: May 1, 1992

Related U.S. Application Data

[63] Continuation-in-part of Ser. No. 708,728, May 31, 1991, Pat. No. 5,230,476.

[51] Int. Cl.[5] ..... B02C 9/00; B02C 23/08

[52] U.S. Cl. ..... 241/101.6; 241/101.8

[58] Field of Search ..... 241/101.3, 101.6, 101.8; 366/91, 178; 222/132

[56] References Cited

U.S. PATENT DOCUMENTS 3,173,582 3/1965 Walter ..... 222/132

*Primary Examiner*—Mark Rosenbaum
*Assistant Examiner*—John M. Husar
*Attorney, Agent, or Firm*—Baker & Daniels

[57] ABSTRACT

A portable feed mill system consists of a housing containing a primary constituent tank, a first feed processor positioned to receive output from the primary constituent tank and a second feed processor. The second feed processor is positioned to receive the output from the first feed processor and an optional secondary feed constituent from either an integral or an external secondary feed constituent tank. Because the system is contained in a single housing, it may be remotely manufactured and transported to its final location at a cost far less than the cost of a conventional feed mill.

36 Claims, 4 Drawing Sheets

VERTICAL FEED MILL SYSTEM

CROSS REFERENCE TO RELATED APPLICATION

This is a continuation-in-part of application Ser. No. 07/708,728 filed May 31, 1991 now U.S. Pat. No. 5,230,476.

BACKGROUND OF THE INVENTION

This invention relates to agricultural systems for processing measured quantities of feed constituents to form the desired finished product, and in particular to grinding and mixing, pelletizing and cooling, extruding and cooling, or cleaning and bagging measured quantities of feed constituents to form the desired finished feed product.

Many of today's feed mill systems are relatively large structures capable of yielding large quantities of feed from a number of feed constituents. These large-capacity feed mill systems usually include several large storage tanks, at least one feed processor, and a control system. An example of a feed mill system used to mix a number of feed constituents is shown in U.S. Pat. No. 3,822,056, in which the control system permits for the mixing of accurately measured quantities of macro-ingredients and micro-ingredients, both liquid and dry.

The use of a common feed processor for all feed constituents in a large-capacity feed mill provides a great deal of flexibility in the types of constituents than can be processed by the system, even though, in many instances, only a primary constituent, such as corn, needs to be processed by a particular feed processor. Therefore, the flexibility of the large-capacity feed mill system results in a configuration which requires power to transfer the constituents over long distances to the feed processor(s) and which covers a large geographic area. For example, separate feed constituents are normally stored in individual feed towers having inlets at the top of the towers and outlets at the bottom of the towers. To mix feed constituents, each constituent must be elevated and transferred to a separate common processor (such as a mixer) located in another tower. Thus, significant expense is incurred in constructing and maintaining separate towers to house the feed constituents and the mixer, and in providing and operating augers to elevate the contents of each feed tower and transfer them to the mixer.

As a result, feed mill systems are usually owned and operated only by large agricultural cooperatives or very large individual farm operators that use a large volume of feed. The expense of these systems is, in part, caused by the need to completely construct the mill at the site. Thus, the construction and maintenance costs of present feed mill systems, are prohibitively high for an individual farmer or a small agricultural cooperative that only needs moderate amounts of feed.

SUMMARY OF THE INVENTION

The present invention provides a compact, portable feed mill system capable of processing a primary constituent and one or more secondary constituents. Specifically, a primary constituent may be processed prior to being processed together with the secondary constituent(s). The orientation of the housing containing these elements is such that a limited amount of square footage is required for the feed mill system and such that gravitational forces alone are capable of transferring the constituents within the feed mill system.

The invention, in one form thereof, provides a portable feed mill system having a housing containing a primary constituent tank, a first feed processor positioned to receive output from the primary constituent tank, a second feed processor, and a means for receiving a secondary tank, a second feed processor, and a means for receiving a secondary constituent. The second feed processor is positioned to receive the output from the first feed processor and at least one secondary feed constituent from an external secondary feed constituent tank. The invention, in accordance with another embodiment thereof, provides at least one integral secondary constituent tank within the housing. Because the system is contained in a single housing, it may be remotely manufactured and transported to its final location at a cost far less than the cost of a conventional feed mill.

Accordingly, one object of the present invention is to provide a feed mill system that is inexpensive, easy to manufacture and capable of processing constituents that can be processed with large-capacity feed mill systems without requiring a great deal of square footage at the installation site.

Another object of the present invention is to provide an agricultural feed mill system that can be transported as a single unit from a manufacturing facility to the installation site and, therefore, is easy, quick and inexpensive to install.

It is still another object of the present invention to minimize the amount of energy required to transfer feed constituents while producing the desired finished product.

It is still another object of the present invention to provide a vertical feed mill system architecture which can be utilized for a variety of feed processes.

DETAILED DESCRIPTION

Figure 1:
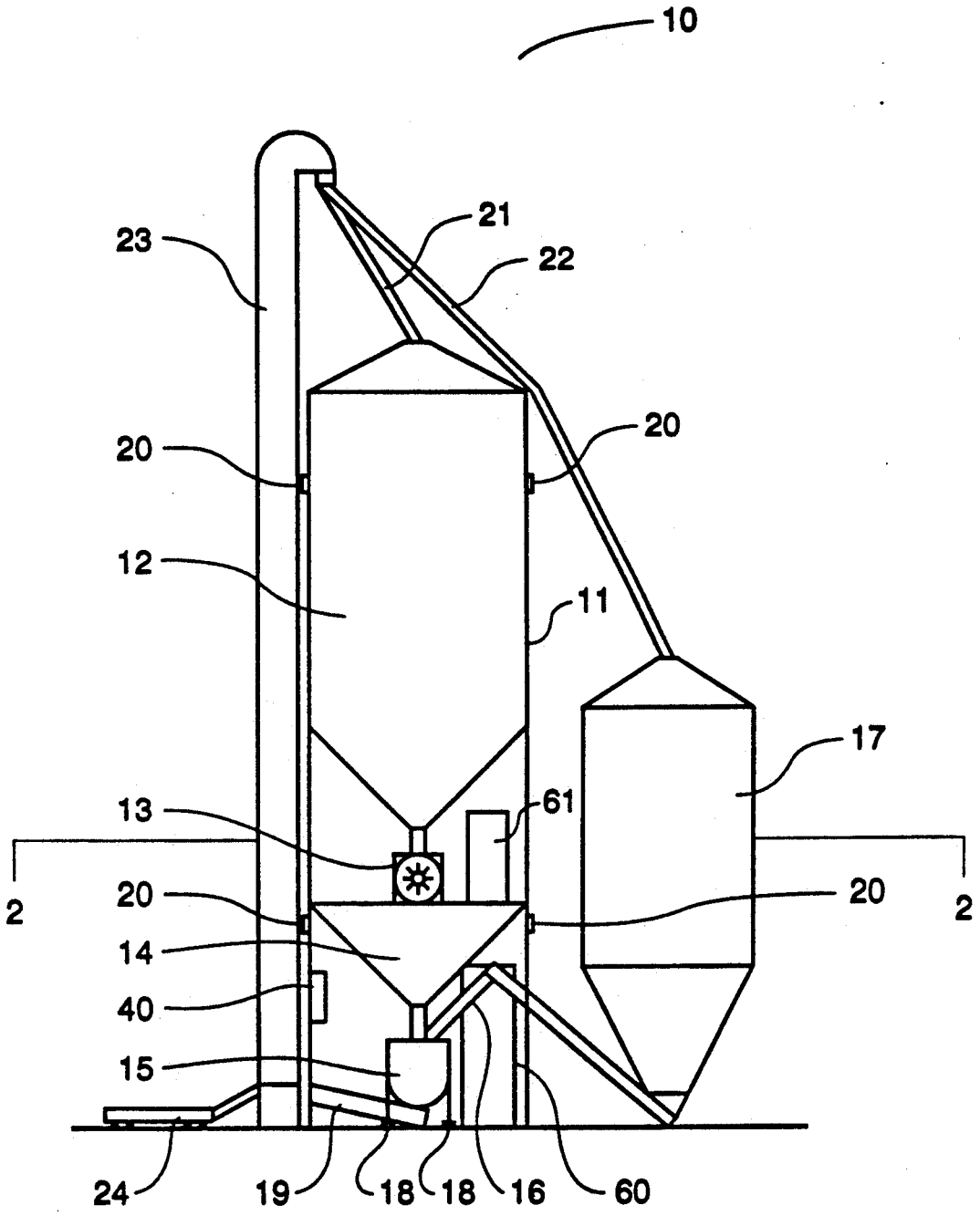
FIG. 1 shows a vertical cross-sectional view of one embodiment of the present invention.

Referring to FIG. 1, there is shown a vertical cross-sectional diagrammatic view of a feed mill system in accordance with the present invention. Feed mill system 10 is capable of processing feed constituents with first feed processor 13 and further processing one or more feed constituents with second feed processor 15 to produce a desired finished product. Feed mill system 10 consists of common portable housing 11 to which attachment means, such as brackets 20, are affixed to allow common housing 11 and its contents to be moved or lifted as a single unit and transported to the installation site. Access doors 61, 60 provide access through housing 11 to first feed processor 13 and second feed processor 15. Primary constituent tank 12 may be filled with a primary feed constituent, which is to be processed with first feed processor 13 before it is further processed with second feed processor 15. Various combinations of processors may be used in feed mill system 10 such as a grinder and a mixer, a pelletizer and a cooler, an extruder and a cooler, and a cleaner and bagger. If first and second feed processors 13 and 15 are a grinder and a mixer, respectively, a primary feed constituent, such as corn, may be ground with grinder 13 before it is mixed with other feed constituents by mixer 15 to yield the desired feed product. For other combinations, such as pelletizing and cooling, only one feed constituent may be processed by both feed processors 13 and 15. However, if second feed processor 15 accommodates secondary feed constituents, secondary constituent tank(s) 17 are each filled with a secondary feed constituent, such as oats, soybean meal or salt in the case of the grinder/mixer combination, which are processed with the pre-processed primary feed constituent. Hopper 14 provides means for transferring the primary constituent from first feed processor 13 to second feed processor 15, and chute 16 provides means for introducing at least one secondary constituent to second feed processor 15, if so desired. Primary constituent tank 12, first feed processor 13, primary constituent or batching hopper 14 and second feed processor 15 are all affixed to and located in common housing 11 and positioned such that gravitational forces alone are capable of causing a primary constituent to move from primary constituent tank 12, through first feed processor 13, through primary constituent hopper 14 and through second feed processor 15.

Bucket elevator 23 (available from Riley Equipment Corp.), and loading augers 21, 22 provide means for loading primary and secondary constituent tanks 12 and 17 with feed constituents. Conveyor 19 receives and conveys the output of second feed processor 15. Any or all of the components of loading means 21, 22, 23 may optionally be attached to common housing 11.

Digital scale load cells 18, available from Hardy Instruments, are positioned below second feed processor 15 such that scale load cells 18 measure the weight of the primary and secondary constituents in second feed processor 15 together with second feed processor 15. Computer control panel 40, available from Wilson Design Builders, Inc., located on the inside wall of housing 11, is connected to scale load cells 18, hopper slide gates and augers throughout the system, and controls the amount of the primary and secondary constituents introduced to second feed processor 15 to produce the finished product.

During the operation of feed mill system 10, a primary constituent within primary constituent tank 12 moves into first feed processor 13 where it is processed. The processed primary constituent then moves through primary constituent hopper 14 toward second feed processor 15. Secondary constituent(s) from secondary tank(s) 17 move through chute 16 to join the processed primary constituent in second feed processor 15. It will be appreciated that computer control of the type well-known in the art is used to control the amount of primary constituent introduced into first feed processor 13, the amounts of processed primary constituent and secondary constituents introduced to second feed processor 15, and the processing time. It will be further appreciated that a primary constituent can be processed in first feed processor 13 while pre-processed primary constituent and secondary constituents are further processed in second feed processor 15.

It will be appreciated by those of skill in the art that a variety of combinations of processes may be utilized in the disclosed feed mill system. Those combinations include, but are not limited to, grinding and mixing, pelletizing and cooling, extruding and cooling, and cleaning and bagging. Representative processors are available from the following sources: a grinder is available from Jacobson Manufacturing; a mixer is available from Scott Equipment Co., New Prague, Minn.; a pellet mill (pelletizer) and a cooler are available from California Pellet Mill, Inc., Crawfordsville, Ind.; an extruder is available from Triple F, Inc.; a cleaner comprising a rotary shaker deck is available from Rotex, Inc. in Cincinnati, Ohio; and, a bagger is available from Bemis Packaging Machinery, Co., Minneapolis, Minn. Again, as discussed above, many of the processing combinations do not require the introduction of secondary feed constituents, but rather are comprised of a single tank for a single constituent.

Figure 2:
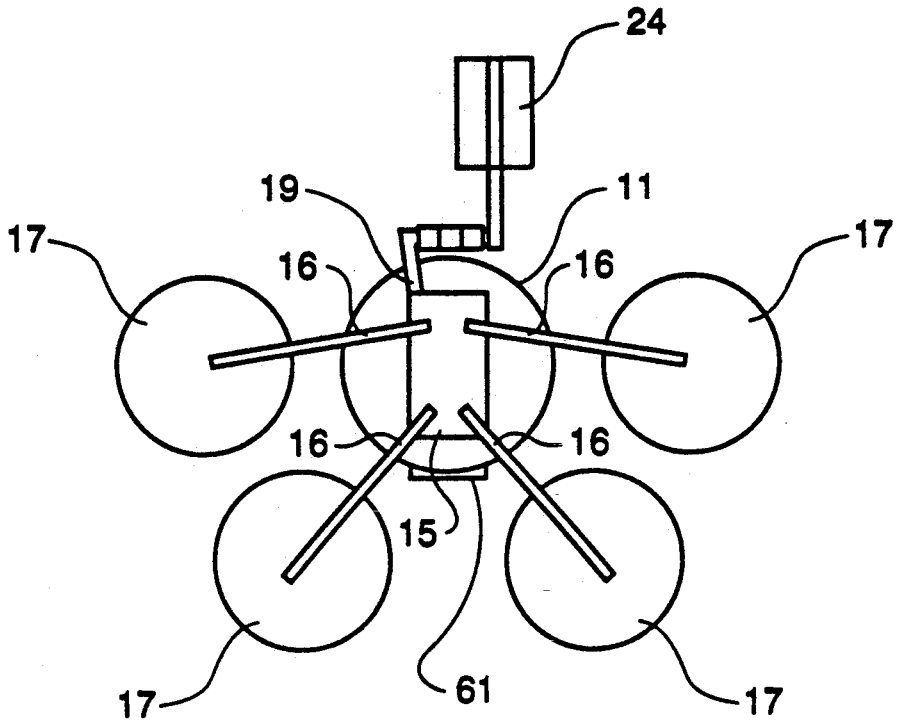
FIG. 2 shows a horizontal cross-sectional view of the embodiment shown in FIG. 1.

FIG. 2 shows a horizontal cross-sectional view of the feed mill system illustrated in FIG. 1 which utilizes four external secondary constituent tanks 17. In one embodiment, chutes 16 introduce a secondary constituent to second feed processor 15 and are radially positioned with respect to the center of second feed processor 15. Chutes are provided above the second feed processor, so that once the secondary feed constituents enter housing 12, the force of gravity alone causes the secondary feed constituents to move toward second feed processor 15.

Figure 3:
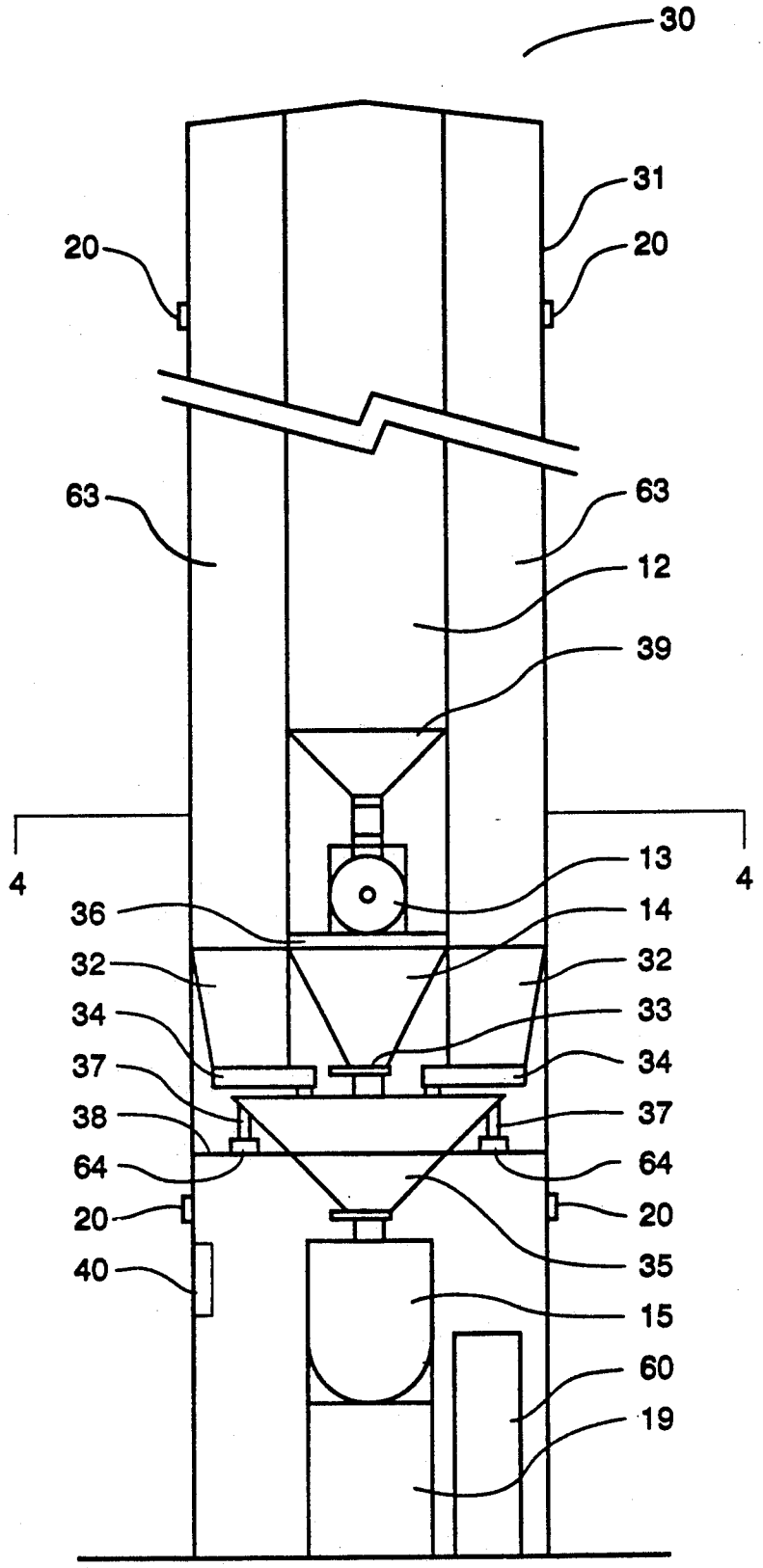
FIG. 3 shows a vertical cross-sectional view of another embodiment of the present invention in which all components of the feed mill are enclosed in a common portable housing.

Referring to FIG. 3, there is shown a vertical cross-sectional diagrammatic view of another embodiment of the present invention in which feed mill system 30 consists of common portable housing 31 to which brackets 20 are affixed to permit common housing 31 and its contents to be moved and lifted as a single unit. Primary constituent tank 12, secondary constituent tank(s) 63, first feed processor 13, primary constituent hopper 14, secondary constituent hopper(s) 32, batching hopper 35, and second feed processor 15 are all contained in common housing 31. Primary constituent tank 12 is centered in common housing 31, secondary constituent tank(s) 63 are located between primary constituent tank 12 and the exterior of common housing 31, and primary constituent tank 12 and secondary constituent tank(s) 63 share a common wall. Furthermore, secondary constituent tank(s) 63, secondary constituent hopper(s) 32, and second feed processor 15 are positioned such that gravitational forces alone are capable of causing a secondary constituent to move from secondary constituent tank 63, through secondary constituent hopper 32 and batching hopper 35, and into second feed processor 15.

Batching hopper 35 is supported from crossbar 38 by four support arms 37, each of which includes a digital scale load cell 64 connected to computer control 40 to weigh the primary and secondary constituents together with batching hopper 35. Feeder screws 34, available from Screw Conveyor Corp., assist in the controlled transfer of the secondary feed constituent between secondary constituent hoppers 32 and batching hopper 35. Feeder screws 34 and slide gate 33 may be controlled manually, such as with levers (not shown), or automatically, such as with the assistance of a computer control system as is illustrated by control panel 40. It will be appreciated that other types of equipment, such as a bin vibrator, can be used in place of feeder screws 34. Additionally, conveyor means 19 may be placed below the second feed processor (as shown in FIG. 1) to receive and convey the feed output of the second feed processor, and a bucket elevator, similar to bucket elevator 23 shown in FIG. 1, may be used for loading feed constituents into primary 12 and secondary 63 constituent tanks or for moving processed feed to a storage tank (not shown). The means provided for loading feed constituents may optionally be attached to common housing 31 such that the amount of construction required at the installation site is reduced.

During the operation of feed mill system 30, a primary constituent from primary constituent tank 12 enters first feed processor 13 through hopper 39. The processed primary constituent then moves through primary constituent hopper 14 and past slide gate 33 into batching hopper 35. A secondary constituent moves from secondary constituent tank 63, through secondary constituent hopper 32 and feeder screw 34 into batching hopper 35. The primary and each secondary feed constituent may be separately transported to batching hopper 35, so that the amount of each constituent may be separately weighed. After the proper weight of each constituent has been combined in batching hopper 35, slide gate 70 of batching hopper 35 is opened to cause the constituents to enter second feed processor 15, where they are processed. While being processed at the second feed processor, another batch of feed constituents may be measured into batching hopper 35. It will be appreciated that computer control system 40 may be programmed to control the amount of primary constituent that enters first feed processor 13 and the amount of processed primary constituent and secondary constituents that enter batching hopper 35.

Figure 4:
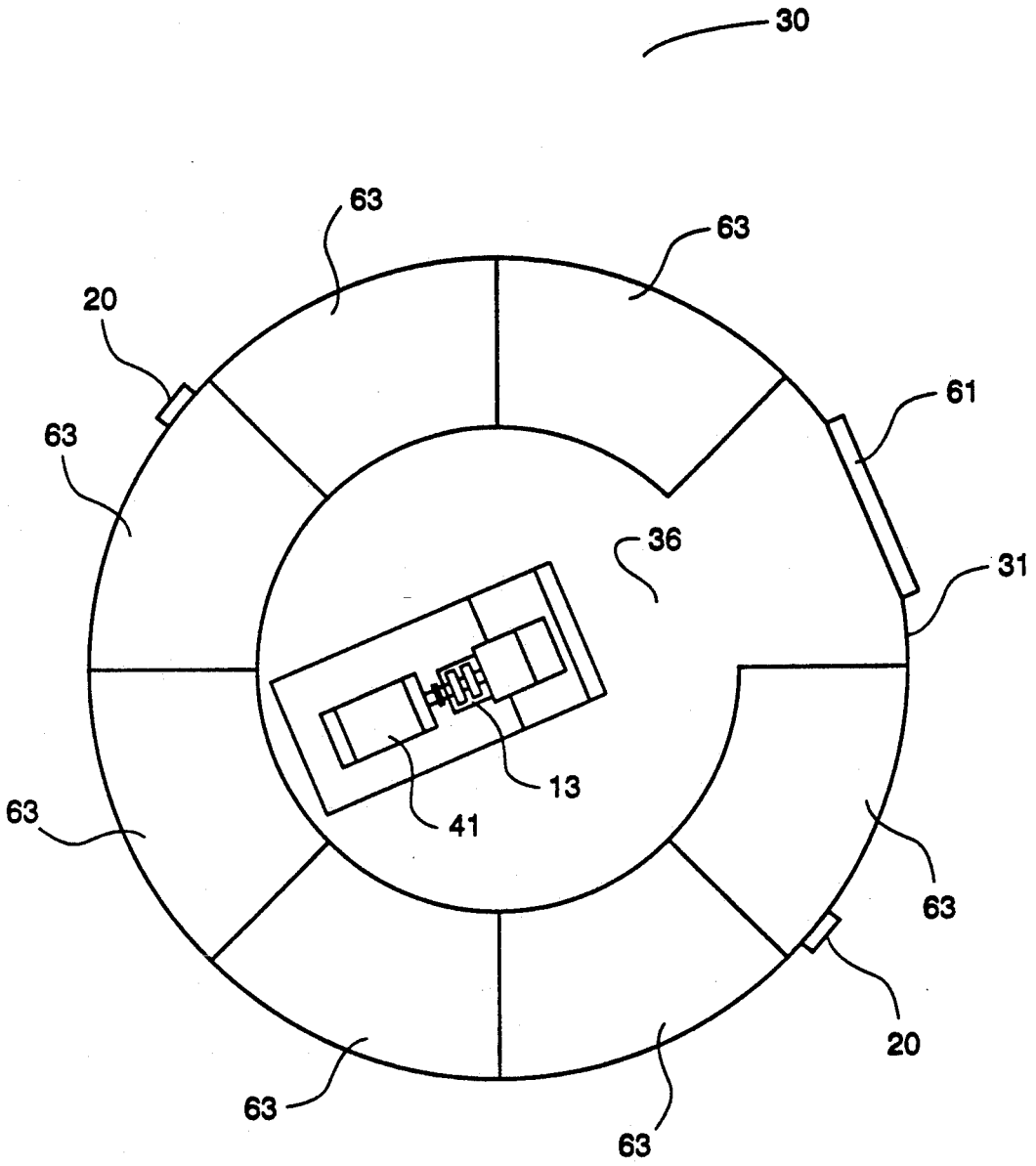
FIG. 4 shows a horizontal cross-sectional view of the embodiment shown in FIG. 3.

FIG. 4 shows a horizontal cross-sectional view of the feed mill system 30 illustrated in FIG. 3 which utilizes several secondary constituent tanks 63. Shown in the center of housing 31 is second feed processor 15 powered by second feed processor motor 41. Primary constituent tank 12 is centered in common housing 31 and secondary constituent tanks 63 are located between primary constituent tank 12 and the outside of common housing 31. Lower access door 60 is provided to allow entry into common housing 31, and upper access door 61 provides entry to service platform 36. Primary 14 and secondary 32 constituent hoppers, primary and secondary constituent tanks 12 and 63, and batching hopper 35 are all available from Peabody TecTank.

The common housing for the two embodiments disclosed herein may be approximately fourteen feet in diameter and seventy feet tall. This size allows for convenient transport to the installation location following the manufacture of the system.

It will be appreciated by those of skill in the art that because the entire feed mill system disclosed herein is contained in a single housing, the system may be manufactured at a factory and then transported to the installation site. Factory assembly results in a much lower cost for the system when compared to conventional feed mills which are usually much larger and constructed at the installation site. Moreover, because all feed constituent tanks may be combined into a single unit, the system occupies much less square footage than a conventional mill. In addition, the vertical arrangement of the various components of the system allow the force of gravity alone to move the constituents through the system, thus eliminating the energy costs associated with conventional systems to lift the feed constituents to different towers for processing.

It will be further appreciated that architecture of the present invention can be utilized for a variety of feed processes. In many instances, changing processes only requires the replacement of first and second feed processors 13 and 15. For other applications, secondary feed constituents may be processed with second feed processor 15 through the addition of optional secondary feed tanks and a means for transferring the secondary feed constituent from the secondary feed tank to the second feed processor.

We claim:

1. A feed mill system comprising:
a primary constituent tank;
a first feed processor positioned to receive output from the primary constituent tank;
at least one secondary constituent tank;
a batching hopper means structurally aligned with the first feed processor to receive output therefrom, and structurally aligned with the secondary constituent tank to receive therefrom output which bypasses the first feed processor;
a second feed processor structurally aligned with the batching hopper means to receive output therefrom; and
a common portable housing for the primary constituent tank, the first feed processor, the second feed processor, the batching hopper means, and the secondary constituent tank.

2. The feed mill system of claim 1 wherein the first feed processor comprises a grinder and the second feed processor comprises a mixer.

3. The feed mill system of claim 1 wherein the first feed processor comprises a pelletizer and the second feed processor comprises a cooler.

4. The feed mill system of claim 1 wherein the first feed processor comprises an extruder and the second feed processor comprises a cooler.

5. The feed mill system of claim 1 wherein the first feed processor comprises a cleaner and the second feed processor comprises a bagger.

6. The feed mill system of claim 1 wherein the primary constituent tank, the first feed processor, the batching hopper means, and the second feed processor are positioned such that gravitational forces alone are capable of causing the primary constituent to move from the primary constituent tank, through the first feed processor, through the batching hopper means and through the second feed processor.

7. The feed mill system of claim 6 wherein the secondary constituent tank, the batching hopper means and the second feed processor are positioned such that gravitational forces alone are capable of causing a secondary constituent to move from the secondary constituent tank, through the batching hopper means and into the second feed processor.

8. The feed mill system of claim 1 wherein the secondary constituent tank, the batching hopper means and the second feed processor are positioned such that gravitational forces alone are capable of causing a secondary constituent to move from the secondary constituent tank, through the batching hopper means and into the second feed processor.

9. The feed mill system of claim 1 wherein the primary constituent tank is positioned in a central portion of the housing, and the secondary constituent tank is are positioned intermediate the primary constituent tank and the housing.

10. The feed mill system of claim 9 wherein the primary constituent tank and secondary constituent tank share a common wall.

11. The feed mill system of claim 1 wherein the common housing includes an attachment means for lifting and moving the housing.

12. The feed mill system of claim 1 further comprising a conveyor means for receiving and conveying output of the second feed processor.

13. The feed mill system of claim 1 further comprising means attached to the common housing for loading the primary constituent tank with feed constituents.

14. The feed mill system of claim 1 further comprising means for controlling the amount of the primary constituent introduced to the second feed processor.

15. The feed mill system of claim 1 further comprising a scale capable of measuring the weight of the primary constituent introduced to the second feed processor.

16. The feed mill system of claim 15 further comprising the batching hopper means positioned above the second feed processor, and in which the batching hopper means hangs from the scale.

17. The feed mill system of claim 16 wherein the scale supports the second feed processor and is capable of measuring the weight of the primary and secondary constituents in the second feed processor together with the second feed processor.

18. The feed mill system of claim 1 wherein the second feed processor is structured to discharge output at a location below and substantially in vertical alignment with the primary constituent tank and the first feed processor.

19. A feed mill system comprising:

a primary constituent tank;

a first feed processor positioned to receive output from the primary constituent tank;

a second feed processor structured to discharge output at a location below and in substantial vertical alignment with the primary constituent tank and the first feed processor;

means for transferring a primary constituent from the first feed processor to the second feed processor; and means for introducing at least one secondary constituent to the second feed processor, and a common portable housing for the primary constituent tank, the first feed processor, the second feed processor, the means for transferring the primary constituent from the first feed processor to the second feed processor and the means for introducing at least one secondary constituent to the second feed processor.

20. The feed mill system of claim 19 wherein the first feed processor comprises a grinder and the second feed processor comprises a mixer.

21. The feed mill system of claim 19 wherein the first feed processor comprises a pelletizer and the second feed processor comprises a cooler.

22. The feed mill system of claim 19 wherein the first feed processor comprises an extruder and the second feed processor comprises a cooler.

23. The feed mill system of claim 19 wherein the first feed processor comprises a cleaner and the second feed processor comprises a bagger.

24. The feed mill system of claim 19 wherein the primary constituent tank, the first feed processor, the means for transferring the primary constituent to the second feed processor, and the second feed processor are positioned such that gravitational forces alone are capable of causing the primary constituent to move from the primary constituent tank, through the first feed processor, through the means for transferring the primary constituent to the second feed processor and through the second feed processor.

25. The feed mill system of claim 24 wherein the means for introducing at least one secondary constituent to the second feed processor and the second feed processor are positioned such that gravitational forces alone are capable of causing the secondary constituent to move through the means for introducing at least one secondary constituent to the second feed processor and into the second feed processor.

26. The feed mill system of claim 19 wherein the means for transferring the primary constituent from the first feed processor to the second feed processor includes a batching hopper.

27. The feed mill system of claim 19 wherein the means for introducing at least one secondary constituent to the second feed processor and the second feed processor are positioned such that gravitational forces alone are capable of causing the secondary constituent to move through the means for introducing at least one secondary constituent to the second feed processor and into the second feed processor.

28. The feed mill system of claim 19 wherein the means for introducing at least one secondary constituent to the second feed processor is radially positioned with respect to the center of the second feed processor.

29. The feed mill system of claim 19 wherein the common housing includes an attachment means for lifting and moving the housing.

30. The feed mill system of claim 19 further comprising a scale positioned below the second feed processor such that the scale supports the second feed processor and is capable of measuring the weight of the primary and secondary constituents in the second feed processor together with the second feed processor.

31. The feed mill system of claim 19 further comprising a conveyor means for receiving and conveying output of the second feed processor.

32. The feed mill system of claim 19 further comprising means attached to the common housing for loading the primary constituent tank with a feed constituent.

33. The feed mill system of claim 19 further comprising means for controlling the amount of the primary and secondary constituents introduced to the second feed processor.

34. The feed mill system of claim 19 further comprising a batching hopper positioned above the second feed processor.

35. The feed mill system of claim 19 further comprising at least one secondary constituent tank located in the common portable housing and connected to the means for introducing at least one secondary constituent to the second feed processor.

36. The feed mill system of claim 35 wherein the primary constituent tank and the secondary constituent tank share a common wall.

* * * * *